US008474817B2

(12) United States Patent
Nireki

(10) Patent No.: US 8,474,817 B2
(45) Date of Patent: Jul. 2, 2013

(54) PAPER SHEET PROCESSING DEVICE

(71) Applicant: Takao Nireki, Tokyo (JP)

(72) Inventor: Takao Nireki, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 0 days.

(21) Appl. No.: 13/748,921

(22) Filed: Jan. 24, 2013

(65) Prior Publication Data

US 2013/0134648 A1 May 30, 2013

Related U.S. Application Data

(62) Division of application No. 12/918,912, filed as application No. PCT/JP2009/052873 on Feb. 19, 2009, now Pat. No. 8,376,359.

(30) Foreign Application Priority Data

Feb. 22, 2008 (JP) ..... 2008-040855

(51) Int. Cl.
*B65H 5/34* (2006.01)

(52) U.S. Cl.
USPC ..... 271/270; 271/265.01; 194/206; 194/207

(58) Field of Classification Search
USPC ..... 271/270, 265.01, 265.02; 194/206, 194/207; 209/534
See application file for complete search history.

(56) References Cited

U.S. PATENT DOCUMENTS 6,889,850 B2 * 5/2005 Amari et al. ..... 209/534
7,837,109 B2 * 11/2010 Fujikawa et al. ..... 235/445

* cited by examiner

*Primary Examiner* — Luis A Gonzalez
(74) *Attorney, Agent, or Firm* — Lexyoume IP Meister, PLLC.

(57) ABSTRACT

A paper sheet processing apparatus capable of preventing a paper sheet from being drawn out by an unauthorized action. The bill processing device includes: an insertion slot into which a bill is inserted; a bill conveyance mechanism capable of conveying the bill having been inserted from the insertion slot; a bill reader reading the bill conveyed by the bill conveyance mechanism; an authenticity judging mechanism judging an authenticity of the bill read by the bill reader; and a pulse output part driving a motor for controlling conveyance speed of the bill by a motor of the bill conveyance mechanism. The pulse output part controls the conveyance speed by the bill conveyance mechanism after the completion of reading by the bill reader.

6 Claims, 14 Drawing Sheets

PAPER SHEET PROCESSING DEVICE

CROSS-REFERENCES TO RELATED APPLICATION

This application is a Divisional Application of U.S. patent application Ser. No. 12/918,912, which was filed on Aug. 23, 2010, which is a National Stage application of PCT/JP2009/052873 filed on Feb. 19, 2009, which claims priority to Japanese Patent Application No. 2008-040855 filed on Feb. 22, 2008, the contents of which are incorporated herein by reference.

BACKGROUND OF THE INVENTION

1. Field of the Invention

The present invention relates to a paper sheet processing apparatus (or device) which identifies the authenticity of a bill, a card, a coupon ticket, and so on (hereafter, collectively referred to as a paper sheet) by reading them.

2. Description of Related Art

In general, a bill processing apparatus, which is one of the embodiments of the paper sheet processing apparatus, is incorporated into a service device such as a game medium rental machine installed in a game hall, a vending machine or a ticket-vending machine installed in a public space, or the like which identifies the validity of a bill inserted from a bill insertion slot by a user and provides various types of products and services in accordance with a value of the bill having been judged as valid.

Such a bill processing apparatus comprises, for example, a bill conveyance mechanism which conveys a bill inserted into a bill insertion slot, authenticity judgment means for reading information on the bill being conveyed and judging the authenticity of the read bill, and a bill housing part in which bills judged as being legitimate by the authenticity judgment means are housed, as disclosed in Patent Reference 1. In such a bill processing apparatus, a conveyance speed by a bill conveyance mechanism thereof which conveys the bill is controlled to be constant, and therefore, it is considered that the possibility that a bill judged as being legitimate in an authenticity judgment process is drawn out by a fraudulent activity is not necessarily low.

[Patent Reference 1] Japanese unexamined utility model application publication No. H06-42857

SUMMARY OF THE INVENTION

In the present invention, a paper sheet processing apparatus which is capable of effectively preventing the paper sheet from being drawn out by the fraudulent activity is provided.

Here, the paper sheet processing apparatus comprises: an insertion slot into which a paper sheet is inserted, a conveyance mechanism which is capable of conveying the paper sheet inserted from the insertion slot, a reading device which reads the paper sheet being conveyed by the conveyance mechanism, an authenticity judging unit which judges the authenticity of the paper sheet having been read by the reading device, and a control unit which controls a conveyance speed of the paper sheet by the conveyance mechanism, and wherein the control unit controls the conveyance speed of the conveyance mechanism after reading by the reading device is completed. Further features of the present invention, its nature, and various advantages will be more apparent from the accompanying drawings and the following description of the preferred embodiment.

DESCRIPTION OF NOTATIONS

Figure 1:
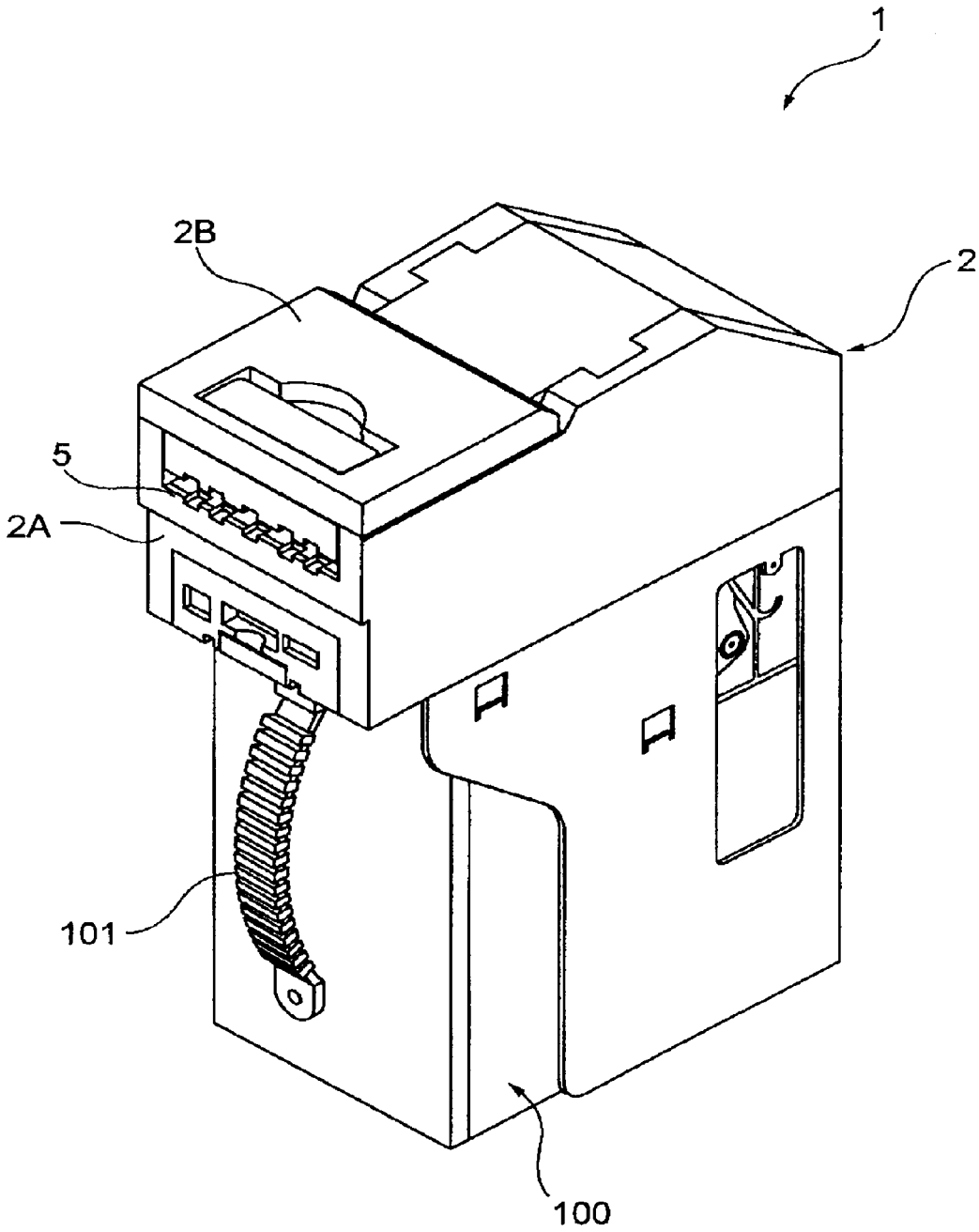
FIG. 1 is a perspective view showing an entire structure to illustrate an embodiment in which a paper sheet processing apparatus according to the present invention is applied to a bill processing apparatus.

1 bill processing apparatus
2 apparatus main body
3 bill traveling route
5 bill insertion slot
6 bill conveyance mechanism
8 bill reading means
10 skew correction mechanism
10A movable piece
13 motor
100 bill housing part
180 pulse output part for motor driving
200 control means

DESCRIPTION OF THE PREFERRED EMBODIMENTS

Hereinafter, an embodiment of the present invention will be described with reference to the drawings.

Figure 2:
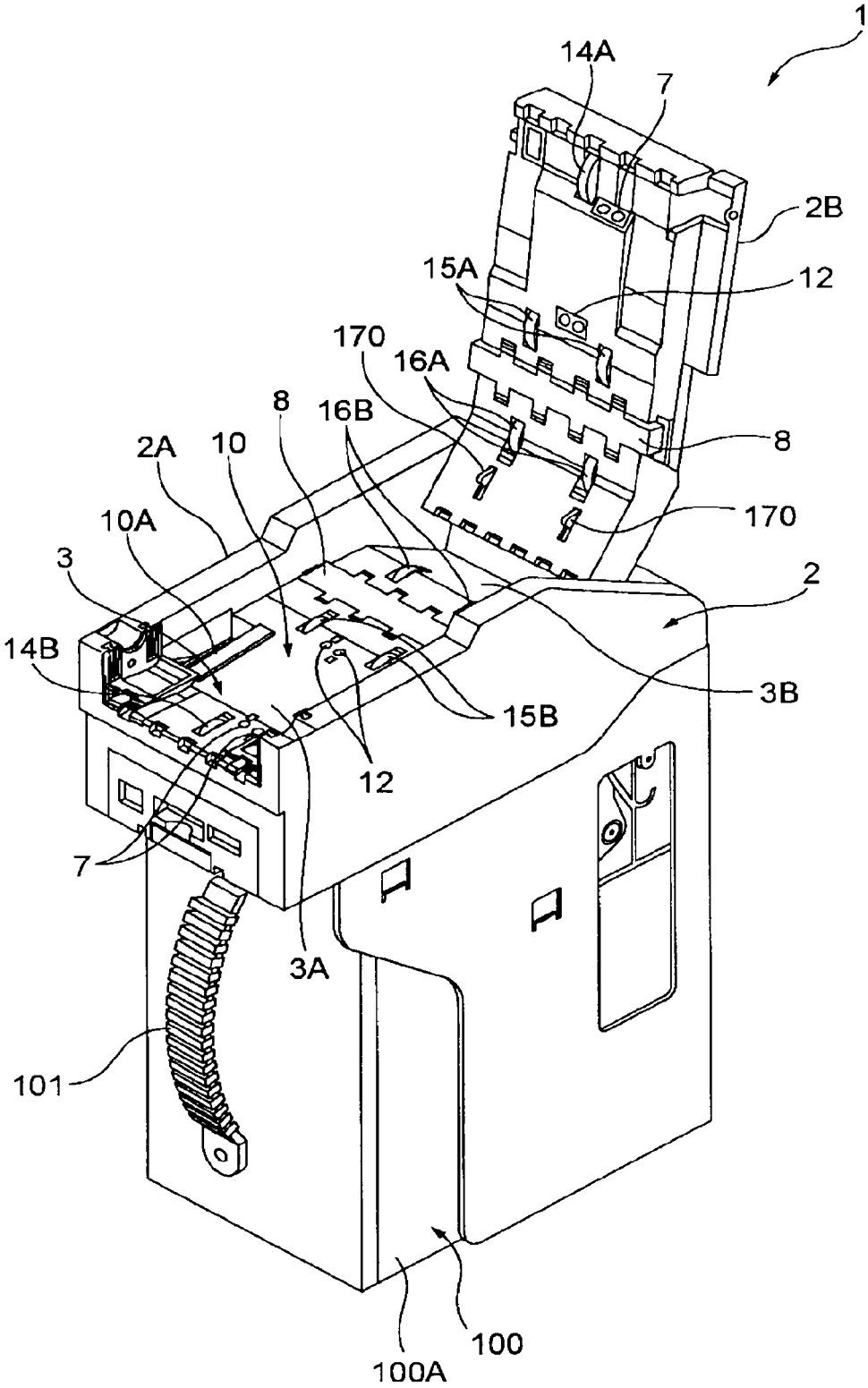
FIG. 2 is a perspective view showing the bill processing apparatus in a state that an open/close member is opened for a main body frame of an apparatus main body.
Figure 3:
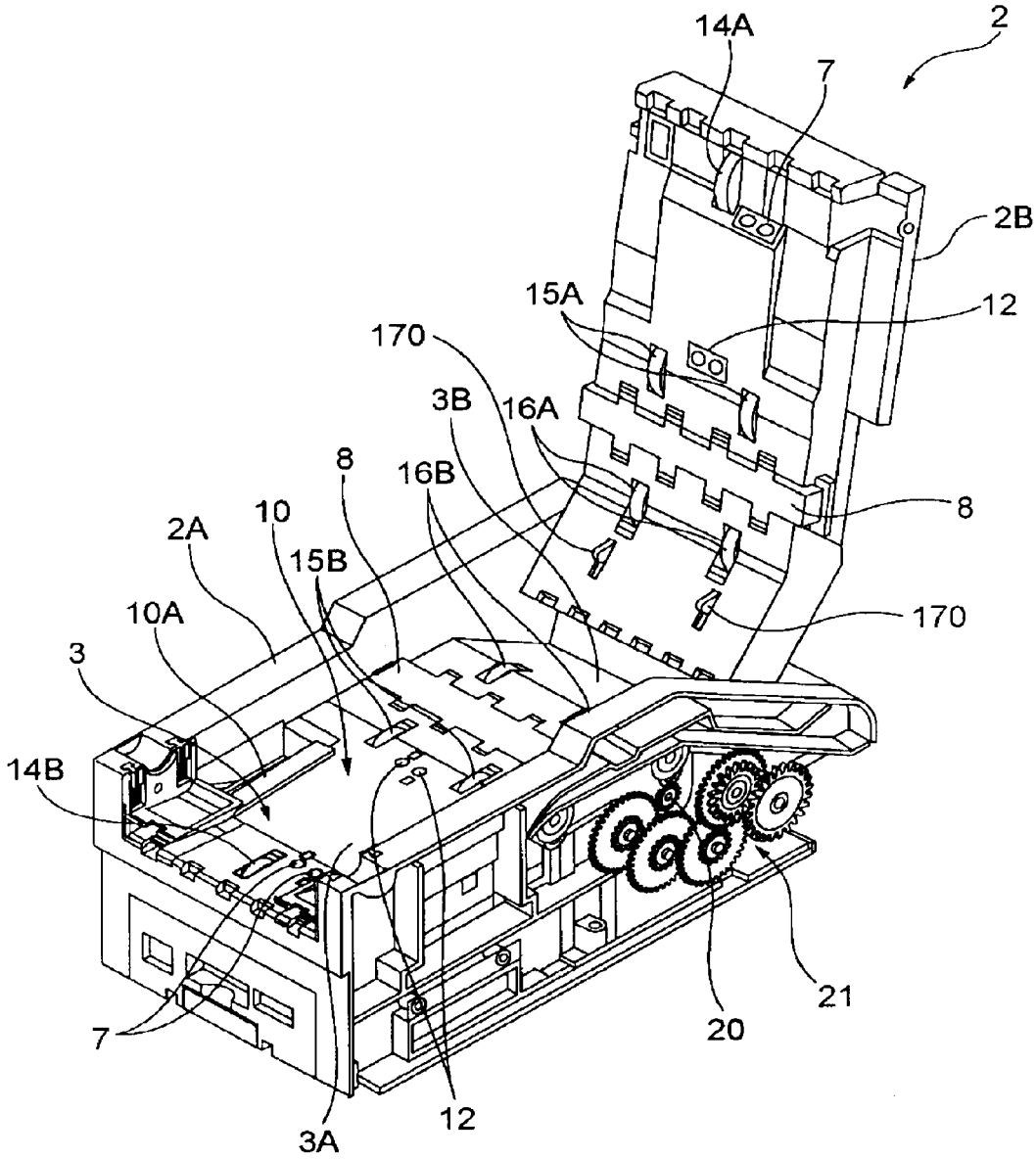
FIG. 3 is a perspective view showing a configuration of a power transmission part of the apparatus main body.
Figure 4:
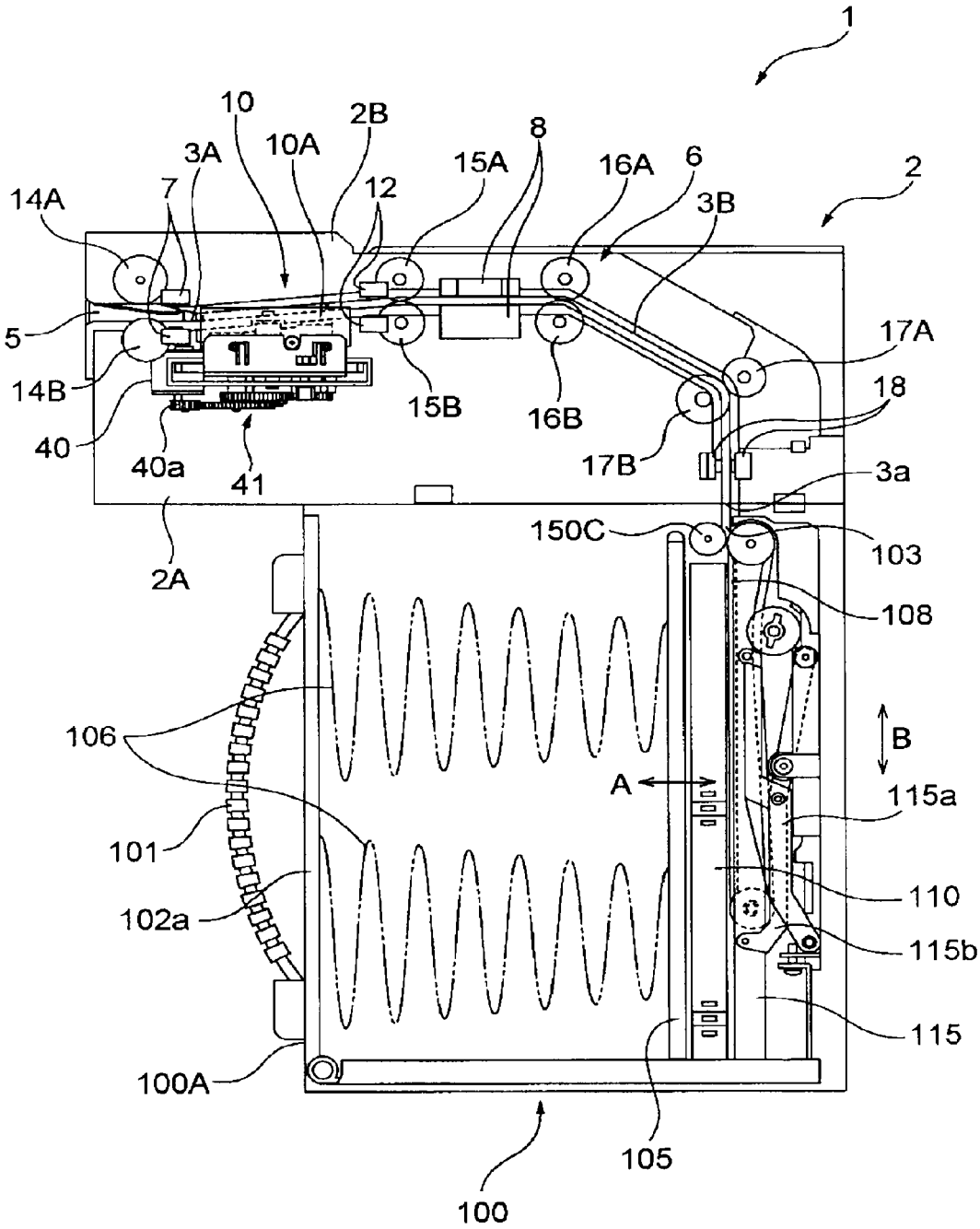
FIG. 4 is a right side view schematically showing a traveling route of a bill to be inserted from an insertion slot.
Figure 5:
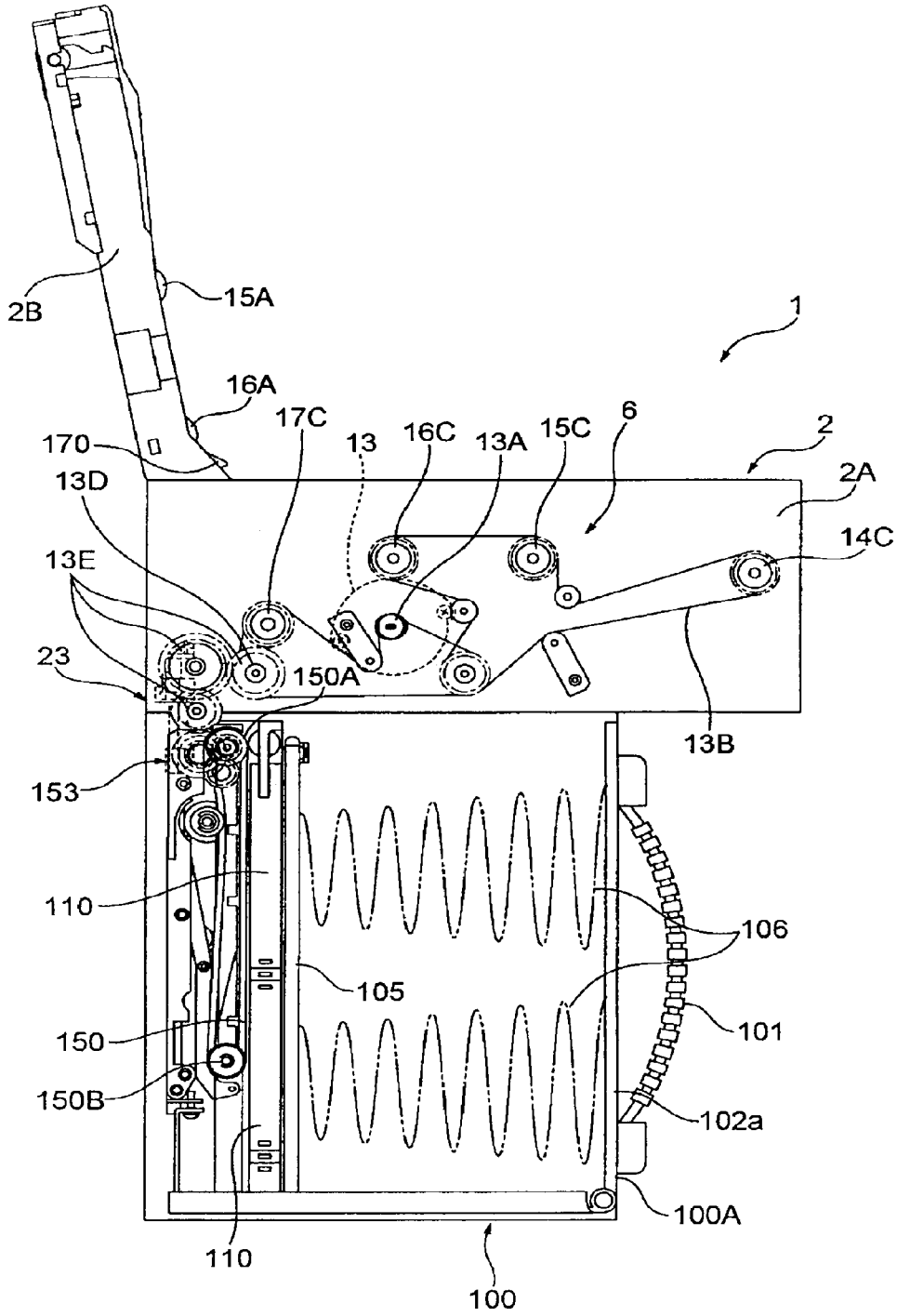
FIG. 5 is a left side view showing a schematic configuration of a driving source and a driving force transmission mechanism to drive a bill conveyance mechanism.
Figure 6:
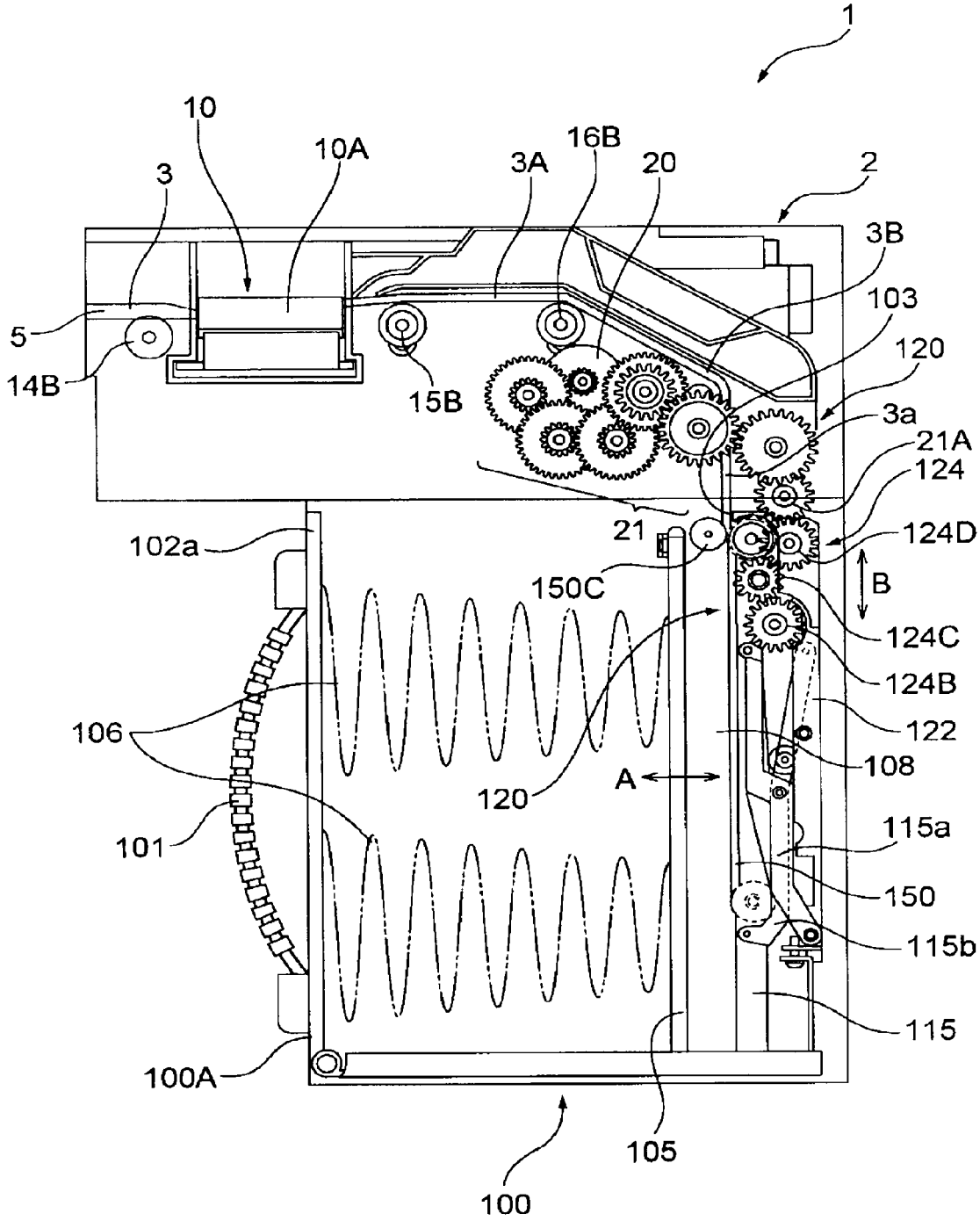
FIG. 6 is a view showing a schematic configuration of a power transmission mechanism for driving a presser plate arranged in a bill housing part.

FIGS. 1 to 6 are diagrams showing an embodiment in which a paper sheet processing apparatus according to the present invention is applied to a bill processing apparatus. FIG. 1 is a perspective view showing an entire structure; FIG. is a perspective view showing a state that an open/close member is opened for a main body frame of an apparatus main body; FIG. 3 is a perspective view showing a configuration of a power transmission part of the apparatus main body; FIG. 4 is a right side view schematically showing a traveling route for a bill to be inserted from an insertion slot; FIG. 5 is a left side view showing a schematic configuration of a driving source and a driving force transmission mechanism to drive a bill conveyance mechanism; and FIG. 6 is a diagram showing a schematic configuration of a driving force transmission mechanism to drive a presser plate installed in a bill housing part.

A bill processing apparatus 1 of this embodiment is so configured that it can be incorporated into, for example, various types of gaming machines such as a slot machine and the like, and the bill processing apparatus 1 includes an apparatus main body 2 and a housing part (e.g., bill housing stacker or cashbox) 100 which is provided to the apparatus main body 2 and is capable of stacking and housing a great number of bills. In this case, the housing part 100 may be mountable to and demountable from the apparatus main body 2, and it is possible, for example, to remove from the apparatus main body 2 by pulling a handle 101 provided on the front face thereof in a state that a lock mechanism (not shown) is unlocked.

As shown in FIGS. 2 and 3, the apparatus main body 2 has a main frame body 2A and an open/close member 2B being configured to be opened and closed for the main body frame 2A by rotating around an axis positioned at one end thereof as a rotating center. Then, as shown in FIG. 4, the main body frame 2A and the open/close member 2B are configured to form a space (bill traveling route) 3 through which a bill is conveyed such that the space is between a bottom face of the open/close member 2B and a top face of the main body frame 2A which are facing with each other when the open/close member 2B is closed for the main body frame 2A, and to form a bill insertion slot 5 such that front exposed faces of both are aligned and that the bill traveling route 3 exits at the bill insertion slot 5. In addition, the bill insertion slot 5 is a slit-like opening from which a short side of a bill can be inserted into the inside of the apparatus main body 2.

Also, in the apparatus main body 2, a bill conveyance mechanism 6 that conveys a bill along a bill traveling route 3; an insertion detecting sensor 7 that detects the bill inserted into the bill insertion slot 5; bill reading means 8 including a bill reading device which is installed on a downstream side of the insertion detecting sensor 7 and reads out information on the bill in a traveling sate; a skew correction mechanism 10 that accurately positions and conveys the bill with respect to the bill reading means 8; a movable piece passage detecting sensor 12 that detects that the bill passes through a pair of movable pieces 10A constituting the skew correction mechanism; and a discharge detecting sensor 18 that detects that the bill is discharged into a bill housing part 100 are provided. Here, the bill reading device may include a detection sensor for bill reading.

Hereafter, the respective components mentioned above will be described in detail. The bill traveling route 3 extends from the bill insertion slot 5 toward the inside, and comprises a first traveling route 3A and a second traveling route 3B extending from the first traveling route 3A toward the downstream side and being inclined downwardly at a predetermined angle to the first traveling route 3A. The second traveling route 3B is bent in a vertical direction on the downstream side and a discharge slot 3*a* from which the bill is discharged into the bill housing part 100 is formed at an end portion on the downstream side such that the bill discharged from the discharge slot 3*a* is fed into a feed port (receiving port) 103 of the bill housing part 100 in the vertical direction.

The bill conveyance mechanism 6 is a mechanism capable of conveying the bill inserted from the bill insertion slot 5 along the insertion direction, and of conveying back the bill in an insertion state toward the bill insertion slot 5. The bill conveyance mechanism 6 comprises a motor 13 serving as a driving source installed in the apparatus main body 2; and conveyor roller pairs (14A and 14B), (15A and 15B), (16A and 16B), and (17A and 17B) which are installed at predetermined intervals along the bill traveling direction in the bill traveling route 3, and are driven to rotate by the motor 13.

Here, the motor 13 is constituted of a stepping motor driven by a pulse signal in this embodiment. This stepping motor (motor 13) is, as will be described later, so configured that a rotational speed thereof is controlled to be changed by changing a generation cycle (period) of a pulse signal by a pulse output part for driving a motor.

In this way, by utilizing a stepping motor for the motor 13, a conveyance speed can be easily controlled by merely changing a generation cycle (period) of a pulse signal.

The conveyor roller pairs are installed so as to be partially exposed on the bill traveling route 3, and all the pairs are constituted of driving rollers of the conveyor rollers 14B, 15B, 16B, and 17B installed on the underside of the bill traveling route 3 driven by the motor 13; and pinch-rollers of the conveyor rollers 14A, 15A, 16A, and 17A installed on the upperside and driven by the these driving rollers. In addition, the conveyor roller pair (14A and 14B) to first nip and hold therebetween the bill inserted from the bill insertion slot 5, and to convey the bill toward the back side, as shown in FIGS. 2 and 3, is installed in one portion of the center position of the bill traveling route 3, and a couple of the conveyor roller pairs (15A and 15B), (16A and 16B), or (17A and 17B) being disposed in this order on the downstream side thereof are respectively installed in a couple of portions with a predetermined interval in the lateral direction of the bill traveling route 3.

Further, the conveyor roller pair (14A and 14B) disposed in the vicinity of the bill insertion slot 5 is usually in a state that the upper conveyor roller 14A is spaced from the lower conveyor roller 14B, and the upper conveyor roller 14A is driven to move toward the lower conveyor roller 14B to nip and hold the inserted bill therebetween when insertion of the bill is sensed by the insertion detecting sensor 7.

Thus, the upper conveyor roller 14A is controllably driven to be pressed against or spaced from the lower conveyor roller 14B by a motor 70 (refer to the block diagram of FIG. 7) for an up-and-down movement of the roller as a driving source. In this case, when a process (skew correction process) for positioning the bill with respect to the bill reading means 8 by eliminating inclination of the inserted bill is executed by the skew correction mechanism 10, the upper conveyor roller 14A is spaced from the lower conveyor roller 14B so as to release the load on the bill, and when the skew correction process is completed, the upper conveyor roller 14A is driven to move toward the lower conveyor roller 14B again to hold (or nip) the bill therebetween. Here, the driving source may be constituted of a solenoid or the like instead of a motor.

The conveyor rollers 14B, 15B, 16B and 17B installed on the underside of the bill traveling route 3 are, as shown in FIG. 5, driven to rotate via the motor 13 and pulleys 14C, 15C, 16C, and 17C installed at the ends of the driving shafts of the respective conveyor rollers. That is, a driving pulley 13A is installed on the output shaft of the motor 13, and a driving belt 132 is wrapped around between the pulleys 14C, 15C, 16C, and 17C installed at the ends of the driving shafts of the respective conveyor rollers and the driving pulley 13A. In addition, tension pulleys are engaged in places with the driving belt 133, which prevents the driving belt 13B from loosening.

In accordance with the configuration described above, when the motor 13 is driven to normally rotate, the conveyor rollers 14B, 15B, 16B, and 17B are driven to normally rotate in synchronization therewith to convey the bill toward the insertion direction. When the motor 13 is driven to reversely rotate, the conveyor rollers 14B, 15B, 16B, and 17B are driven to reversely rotate in synchronization therewith to convey back the bill toward the bill insertion slot 5 side.

The insertion detecting sensor 7 is to generate a detection signal when a bill inserted into the bill insertion slot 5 is detected. In this embodiment, the insertion detecting sensor 7 is installed between the pair of conveyor rollers (14A and 14B) and the skew correction mechanism 10. The insertion detecting sensor 7 comprises, for example, an optical sensor, specifically for example, a regressive reflection type photo sensor. However, the insertion detecting sensor 7 may comprise a mechanical sensor other than the optical sensor.

Further, the skew correction mechanism 10 comprises the pair of movable pieces 10A (only one of the pair members is shown) correcting skew of the bill. The movable pieces 10A have a function to correct an inclination of the bill by touching both sides of the bill to be conveyed as they are driven to get close to or spaced from each other in a direction perpendicular to the bill traveling direction by a motor (skew driving mechanism motor) 40 and via a gear train 41 sequentially engaged with an output shaft 40*a* of the motor 40.

Further, the movable piece passage detecting sensor 12 is to generate a detection signal when it is detected that a front end of the bill passes through the movable pieces constituting the skew correction mechanism 10, and the movable piece passage detecting sensor 12 is installed on the upstream side of the bill reading means 8. The movable piece passage detecting sensor 12 also comprises an optical sensor or a mechanical sensor in the same way as mentioned before with respect to the insertion detecting sensor. In addition, the movable piece passage detecting sensor 12 generates a bill back end detection signal in order to perform a movable piece closing process which will be described later when a back end position of the bill to be carried is detected.

Further, the discharge detecting sensor 18 is to detect a back end of the bill passing through such that it is detected that the bill is discharged into the bill housing part 100. The discharge detecting sensor 18 is disposed just in front of the receiving port 103 of the bill housing part 100 on the downstream side of the second bill traveling route 3B. When the detection signal is transmitted from the discharge detecting sensor 18, the driving by the motor 13 is stopped and the conveyance processing of the bill is terminated. The discharge detecting sensor 18 also comprises an optical sensor or a mechanical sensor in the same way as the aforementioned insertion detecting sensor.

The bill reading means 8 reads bill information on the bill to be conveyed in a state that the skew is eliminated by the skew correction mechanism 10, and judges its validity (authenticity). In detail, for example, the bill reading means 8 may comprise a line sensor that performs reading of the bill such that a bill to be conveyed is irradiated with light from upper and lower sides, and transmitted light therethrough and reflected light therefrom are detected by a light receiving element. A line sensor is shown in the drawing, and an optical signal read by the line sensor is photoelectric-converted, and the signal is compared and checked with data of a legitimate bill stored in advance, which makes it possible to identify the authenticity of the bill to be conveyed.

The bill housing part 100 that houses bills is so configured as to be mountable to and demountable from the apparatus main body 2, and to stack and house sequentially the bills having been identified as being legitimate by the bill reading means 8.

As shown in FIGS. 4 to 6, the main body frame 100A constituting the bill housing part 100 is formed into a substantially rectangular parallelepiped (or cuboid) shape, and one end of bias means (e.g., bias spring) 106 is attached to an interior side of a front wall 102*a* thereof, and a placing plate 105 on which bills to be fed via the above-described receiving port 103 are sequentially stacked is provided to the other end thereof. Therefore, the placing plate 105 is in a state that it is pressed toward the presser plate 115, which will be described later, by the bias means 106.

In the main body frame 100A, a press standby part 108 that keeps a dropping bill as it falls is provided so as to continuously communicate with the receiving port 103. A pair of regulatory members 110 are disposed on both sides of the press standby part 108, respectively, the regulatory members 110 extending in a vertical direction. An opening is formed between the pair of regulatory members 110 such that the presser plate 115 passes through the opening as bills are successively stacked onto the placing plate 105.

The presser plate 115 is formed in such a size that it may be capable of reciprocating through an opening formed between the pair of regulatory members 110, and gets into the opening so configured as to be driven to reciprocate between a position where the bills are pressed against the placing plate 105 (a pressing position) and another position where the press standby part 108 is opened (an initial position).

As a result, the bill guided to the press standby part 108 is pressed by the presser plate 115 to reciprocate inside the opening portion, and the bill passes through the opening portion so as to deflect its center, to be sequentially stacked on the placing plate 105. Then, the bill stacked on the placing plate 105 is biased so as to be pressed against the surface of the pair of regulatory members 110 by the biasing means 106, to be stably held between the placing plate 105 and the pair of regulatory members 110.

The presser plate 115 is driven to reciprocate as described above via a presser plate driving mechanism 120 installed in the main body frame 100A. The presser plate driving mechanism 120 comprises a pair of link members 115*a* and 115*b* having respective ends thereof supported pivotally by the presser plate 115 so as to allow the presser plate 115 to reciprocate in an arrow A direction in FIGS. 4 and 6, and these link members 115*a* and 115*b* are connected in a shape of letter "X", and the other ends opposite to the respective ends are supported pivotally by a movable member 122 installed movably in a vertical direction (an arrow B direction). A rack is formed in the movable member 122, and a pinion constituting the presser plate driving mechanism 120 is geared (engaged) with the rack.

As shown in FIG. 6, a housing part side gear train 124 constituting the presser plate driving mechanism 120 is connected to the pinion. For this case, in this embodiment, a driving source (a motor 20) and a main body side gear train 21 sequentially engaged with the motor 20 are installed in the above-described apparatus main body 2, and when the bill housing part 100 is mounted to the apparatus main body 2, the main body side gear train 21 is to be connected to the housing part side gear train 124. That is, the housing part side gear train 124 comprises a gear 124B installed on the same axis of the pinion and gears 124C, 124D to be engaged sequentially with the gear 1248, and when the bill housing part 100 is mounted to and demounted from the apparatus main body 2, the gear 124D is configured to be engaged with and disengaged from a final gear 21A of the main body side train 21.

As a result therefrom, the presser plate 115 is driven to reciprocate in the arrow A direction as the motor 20 installed in the apparatus main body 2 is driven to rotate so as to drive the main body side train 21 and in turn the presser plate driving mechanism 120 (the housing part side gear train 124, the rack installed onto the movable member 122, and the link members 115*a*, 115*b*, etc.).

Conveyor members 150 which are capable of touching the bill conveyed-in from the receiving port 103 are installed in the main body frame 100A. The conveyor members 150 take their own role to contact the bill conveyed-in so as to stably guide the bill to an appropriate position in the press standby part 108 (position where the bill can be stably pressed without causing the bill to be moved to the right or left side when the bill is pressed by the presser plate 115). In this embodiment, the conveyor members are constituted of belt-like members (hereafter called belts 150) installed so as to face the press standby part 108.

In this case, the belts 150 are installed so as to extend along the conveying-in direction with respect to the bill, and are wrapped around the pair of pulleys 150A and 150B supported rotatably on both ends in the conveying-in direction. Further, the belts 150 contact a conveyor roller 150C extending in an axis direction which is supported rotatably in the region of the receiving port 103, and the belts 150 and the conveyor roller 150C nip and hold the bill conveyed-in the receiving port 103 therebetween to guide the bill directly to the press standby part 108. Moreover, in this embodiment, the pair of belts 150 are provided on the right and left sides, respectively, across the above-described presser plate 115 in order to be capable of contacting the surface on left and right sides of the bill. Here, the belts 150 may be prevented from loosening by not only being wrapped around the pulleys 150A and 150B at the both ends, but also causing tension pulleys to push the belts 150 at the intermediate positions, respectively.

The pair of belts 150 are configured to be driven by the motor 13 that drives the above-described plurality of conveyor rollers installed in the apparatus main body 2. In detail, as shown in FIG. 5, the above-described driving belt 13B driven by the motor 13 is wrapped around a pulley 13D for the driving force transmission, and a gear train 153 installed at the end of the spindle of the pulley 150A supported rotatably on the receiving port 103 side is engaged with a gear train 13E for the power transmission sequentially installed onto the pulley 13D. That is, when the bill housing part 100 is mounted to the apparatus main body 2, an input gear of the gear train 153 is configured to be engaged with a final gear of the gear train 13E, and the pair of belts 150 are configured to be driven to rotate in a synchronized manner with the above-described conveyor rollers 14B, 15B 16B, and 17B for conveying the bill by driving the motor 13 to rotate.

As described above, when the bill is inserted into the inside via the bill insertion slot 5, the bill is moved inside the bill traveling route 3 by the bill conveyance mechanism 6. As shown in FIG. 3, the bill traveling route 3 has the first traveling route 3A which is extended from the bill insertion slot 5 toward the back side, and the second traveling route 3B which is extended from the first traveling route 3A toward the downstream side and is inclined at a predetermined angle to the first traveling route 3A. A shutter member 170 that prevents the bill from being conveyed toward the bill insertion slot 5 by a fraudulent activity is installed in the second traveling route 3B.

Figure 7:
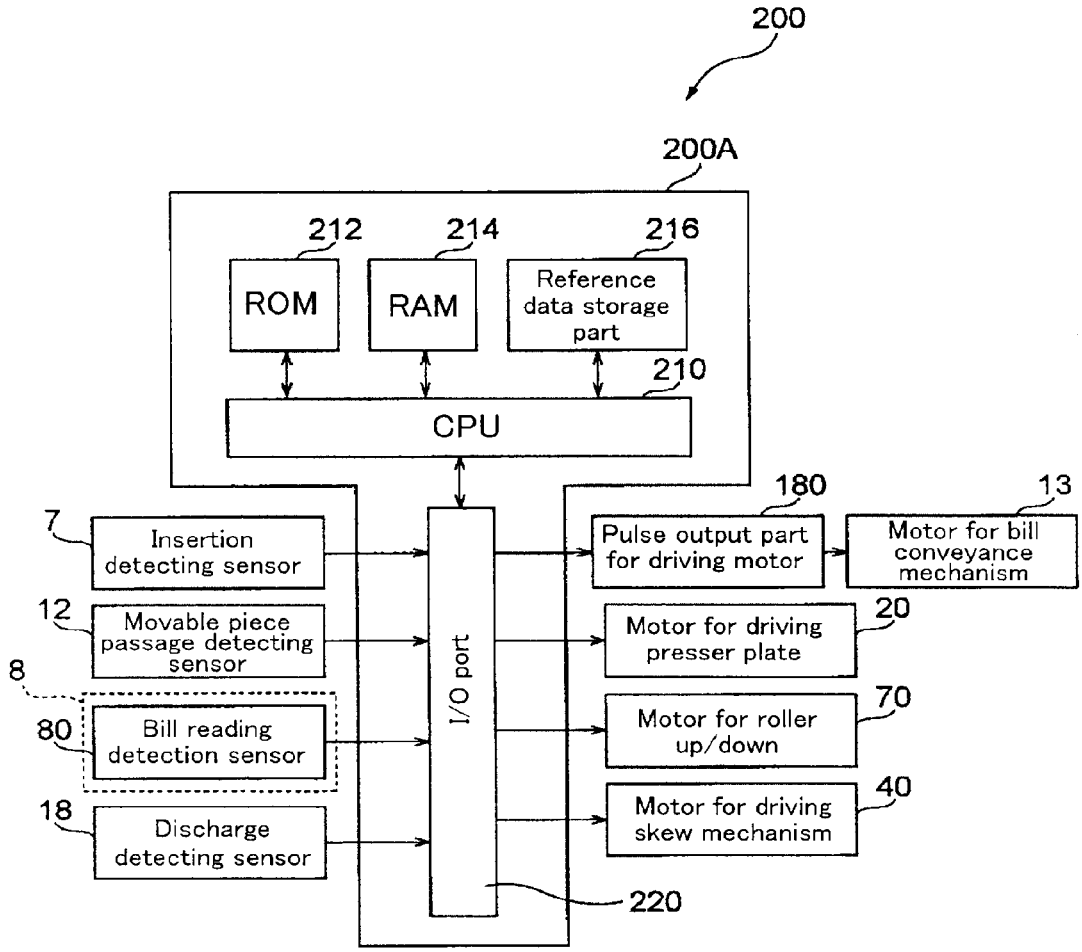
FIG. 7 is a block diagram showing a configuration of control means for controlling driving of the bill processing apparatus.

Next, control means, which includes a control unit, for controlling the driving of the above-described bill processing apparatus will be explained in reference to FIG. 7.

The control means 200 includes a control unit comprising a control circuit board 200A which controls operations of the above-described respective drive units, and a CPU (Central Processing Unit) 210 controlling operations of the apparatus main body and operations at the time of authenticity judgment, a ROM (Read Only Memory) 212, a RAM (Random Access Memory) 214, and a reference data storage part 216 are implemented on the control circuit board.

In the ROM 212, various types of programs such as an authenticity judgment program for the bill read by the bill reading means 8 and operation programs for various types of drive units such as the motor 13 that drives the above-described bill conveyance mechanism, the motor 20 that drives the presser plate, the roller up-and-down motor 70 that drives the conveyor roller 14A to be contacted with and spaced from the conveyor roller 14B, the motor 40 that drives the pair of movable pieces 10A in the skew driving mechanism 10, and permanent data are stored. The CPU 220 generates a control signal according to the programs stored in the ROM 222, and carries out input and output of the signals with the various types of drive units described above via an I/O port 220, so as to perform driving control of the various types of drive units.

Further, detection signals from the insertion detecting sensor 7, the movable piece passage detecting sensor 12, and the discharge detecting sensor 18 are to be input to the CPU 210 via the I/O port 220, and the driving of the various types of drive units is controlled on the basis of these detection signals.

Further, data and programs used for the operation of the CPU 210 are stored in the RAM 214, which further has a function to store temporarily various types of data when a predetermined process such as the authenticity judgment process. Further, reference data used for the performance of the authenticity judgment of the bill, for example, various types of data acquired from all the printed areas of the legitimate bill (for example, data about contrasting density, data about transmitted light or reflected light when the bill is irradiated with infrared ray, and so on) as reference data in the reference data storage part 216. In addition, the reference data is stored in the dedicated reference data storage part 216. However, the data may be stored in the ROM 212.

The above-mentioned CPU 210, ROM 212, RAM 214, and reference data storage part 216 also have a function as the authenticity judging means which judges the authenticity of the bill read by the bill reading means 8. Therefore, these can constitute an authenticity judging unit and the authenticity judging means may include such authenticity judging unit. Then, a bill reading detection sensor (for example, a line sensor) 80 constituting the above-described bill reading means 8 is connected to the CPU 210 via the I/O port 220, and bill reading data read by the bill reading detection sensor 80 is compared with the reference data stored in the reference data storage part 216 such that a bill authenticity judgment process is executed.

Further, as described above, the motor 13 driving the bill conveyance mechanism 6 is constituted of a so-called stepping motor, in which the amount of rotation is proportional to the number of driving pulses (driving pulse number) and the rotational speed is proportional to a frequency of the driving pulse. The motor (stepping motor) 13 is so configured that a rotational speed thereof, i.e., a conveyance speed of the bill, is controlled by control means for controlling a driving speed of the motor (specifically, a pulse output part 180 for driving the motor).

Figure 8:
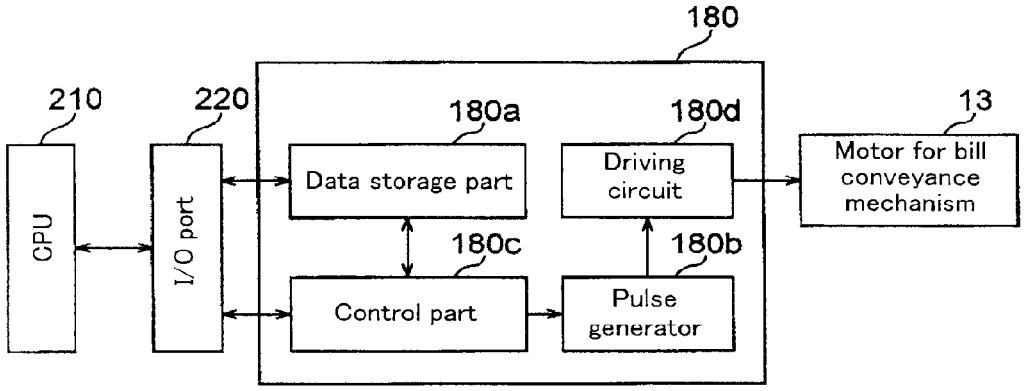
FIG. 8 is a block diagram showing a schematic configuration of a pulse output part for driving a motor.
Figure 9:
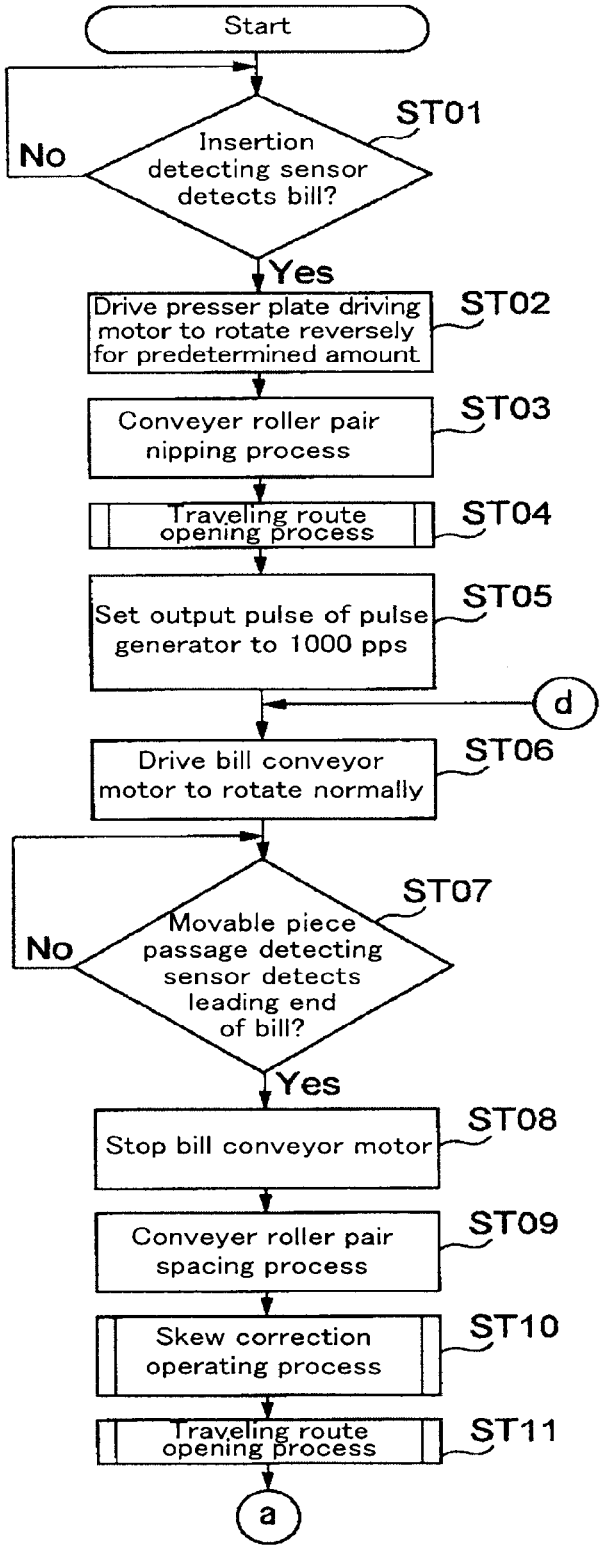
FIG. 9 shows a flowchart (part one) illustrating processing operations for processing the bill in the bill processing apparatus of this embodiment.
Figure 10:
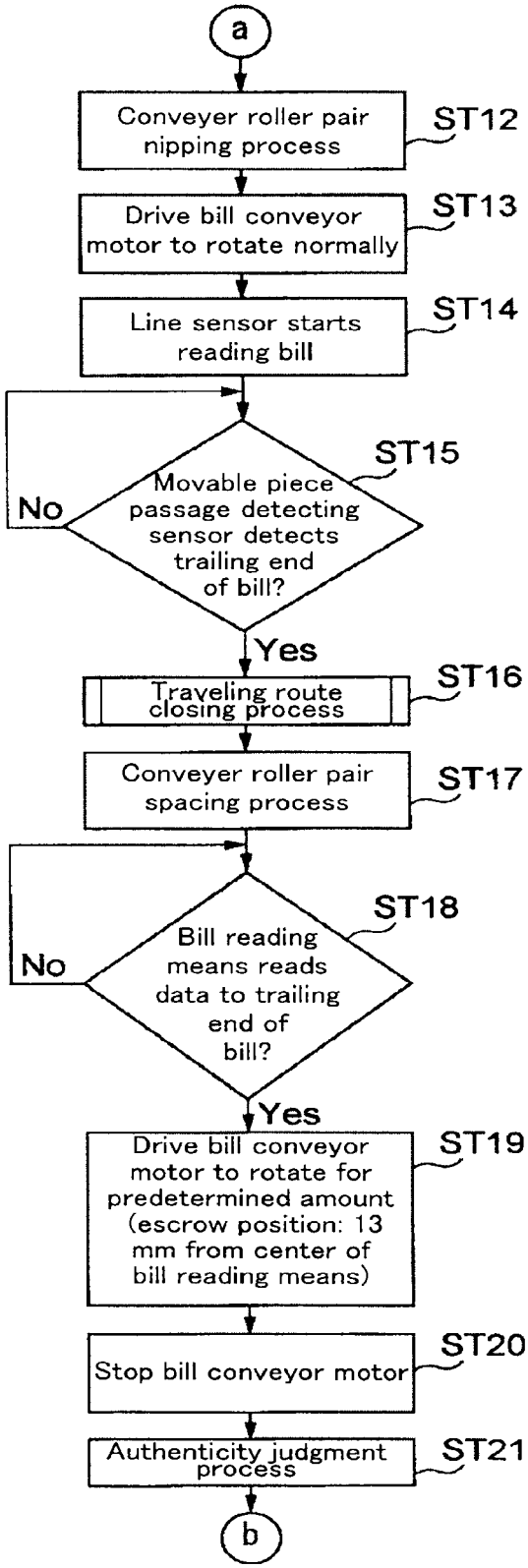
FIG. 10 shows a flowchart (part two) illustrating processing operations for processing the bill in the bill processing apparatus of this embodiment.

As shown in a block diagram of FIG. 8, the pulse output part 180 for driving the motor comprises: a data storage part 180*a* which stores motor operating parameters such as operating speed data and operating direction data for determining a rotating direction of the driving motor on the basis of a result of the authenticity judgment process, a control part 180*c* which instructs a pulse generator 180*b* to output a motor driving pulse on the basis of the operating speed data stored in the data storage part 180*a*, a driving circuit 180*d* which actually operates the motor 13 by a motor driving pulse signal generated from the pulse generator 180*b*, and the like.

Information about the driving speed of the motor, more specifically, normal driving speed information for conveying the bill in a normal state and high driving speed information for conveying the bill at a speed higher than the normal speed are stored in the data storage part 180*a*.

That is, the control part 180*c* receives a control signal from the CPU 210 when the bill is conveyed in the normal state, and instructs the pulse generator 180*b* to output a motor driving pulse (corresponding to 1000 pps) such that the bill traveling speed is set to 254 mm/s with reference to the speed information stored in the data storage part 180*a*. Further, when the bill is conveyed at a high speed, the control part 180*c* receives the control signal from the CPU 210 and instructs the pulse generator 180*b* to output the motor driving pulse (corresponding to 1200 pps) such that the bill traveling speed is set to 304.8 mm/s with reference to the speed information stored in the data storage part 180*a*.

Then, it suffices that the timing for changing the driving speed of the motor 13 from the normal speed to the high speed may be set after the bill reading means 8 reads the information of the bill to be conveyed. In this embodiment, the speed change is triggered when the bill is judged as the legitimate bill after the authenticity judgment process is carried out with the CPU 210 between the data of the read bill and the reference data stored in the reference data storage part 216.

In addition, the control means 200 that controls the operation of the bill processing apparatus being configured as described above is implemented on one control circuit board 200A. However, the control means 200 may be implemented in a distributed manner on separate control circuit boards in accordance with respective functions.

Next, the bill processing operation in the bill processing apparatus 1 executed by the control means will be described with reference to the flowcharts of FIGS. 9 to 14.

When an operator inserts a bill into the bill insertion slot 5, the conveyor roller pair (14A and 14B) installed in the vicinity of the bill insertion slot is in a state that the rollers are spaced from each other in an initial stage (refer to ST17 and ST57 to be described later). Further, with respect to the presser plate 115, as shown in FIGS. 4 and 6, the pair of link members 115*a*, 115*b* driving the presser plate 115 are positioned in the press standby part 108, and the pair of link members 115*a*, 115*b* prevent the bill from being conveyed into the press standby part 108 from the receiving port 103. That is, in this state, the presser plate 115 is brought into the opening formed between the pair of regulatory members 110 such that the opening is in an occluded state so as to prevent the bill stored in the bill housing part from being drawn out.

Moreover, the pair of movable pieces 10A constituting the skew correction mechanism 10 located on the downstream side of the conveyor roller pair (14A, 14B) are in a state that the pair of movable pieces 10A are moved to leave the minimum open width therebetween (for example, an interval between the pair of movable pieces 10A is 52 mm; refer to ST16 and ST58 to be described later) so as to prevent the bill from being drawn out in the initial stage.

As described above, in the initial state of the pair of conveyor rollers (14A and 14B), the operator can easily insert a bill, even if it is wrinkled, into the bill insertion slot 5 since both conveyor rollers are spaced apart. Then, when the insertion detecting sensor 7 detects the insertion of the bill (ST01), the driving motor 20 of the above-described presser plate 115 is driven to rotate reversely for a predetermined amount (ST02) to move the presser plate 115 from the standby position to the initial position. That is, the presser plate 115 is in a state that the presser plate 115 is moved and remains in the opening such that it is so arranged that the bill cannot pass through the opening until the insertion of a bill is detected by the insertion detecting sensor 7.

When the presser plate 115 is moved to the initial position, the press standby part 108 becomes in an open state (refer to FIG. 6) such that the apparatus is in a state that the bill can be conveyed into the bill housing part 100. That is, by driving the motor 20 to rotate reversely for a predetermined amount, the presser plate 115 is moved from the standby position to the initial position via the main body side gear train 21 and the presser plate driving mechanism 120 (the housing part side gear train 124, the rack formed on the movable member 122, and the link members 115*a*, 115*b*).

Further, the above-described roller up-and-down motor 70 is driven to move the upper conveyor roller 14A so as to make a contact with the lower conveyor roller 14B. In accordance therewith, the inserted bill is nipped and held therebetween by the pair of conveyor rollers (14A and 143) (ST03).

Next, a traveling route opening process is conducted (ST04). The opening process is conducted by driving the pair of movable pieces 10A to move in separating directions so as to become apart with each other as the motor 40 for the skew correction mechanism is driven to rotate reversely as shown in the flow chart of FIG. 12 (ST100). At this time, when it is detected that the pair of movable pieces 10A have moved to the predetermined positions (the maximum open width positions) by the base part detecting sensor that detects positions of the pair of movable pieces 10A (ST101), the driving operation to rotate the motor 40 reversely is stopped (ST102). This traveling route opening process allows the bill to enter between the pair of movable pieces 10A. In addition, in the previous step of ST04, the bill traveling route 3 is in a closed state by a traveling route closing process (ST16, ST58) to be described later. Thus, the bill traveling route 3 is closed in this way before an insertion of the bill so as to prevent an element such as a line sensor from being broken by, for example, inserting a plate-like member from the bill insertion slot for illicit purposes or the like.

Next, the control part 180*c* of the pulse output part 180 for driving the motor instructs the pulse generator 180*b* to output a motor driving pulse (corresponding to 1000 pps) such that a conveyance speed of the bill is set to 254 mm/s which is the normal conveyance speed, and thereafter, the motor (stepping motor) 13 for conveying the bill is driven to normally rotate (ST05, ST06). Thereby, the bill is conveyed toward inside of the apparatus by the conveyor roller pair (14A and 14B).

Then, when the movable piece passage detecting sensor 12 installed on the downstream side from the skew correction mechanism 10 detects the leading end of the bill, the bill conveyor motor 13 is stopped (ST07 and ST08). At this time, the bill is located between the pair of movable pieces 10A constituting the skew correction mechanism 10.

Subsequently, the above-described roller up-and-down motor 70 is driven to allow the conveyor roller pair (14A and 14B) holding the bill therebetween to become apart from each other (ST09). At this time, the bill is in a state that no load is applied.

Figure 13:
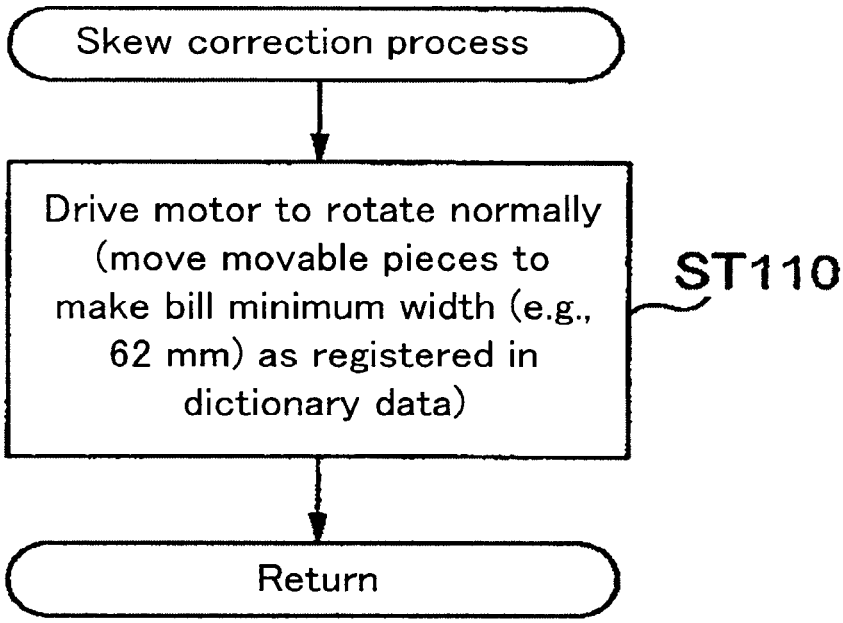
FIG. 13 shows a flowchart illustrating processing operations of a skew correction operating process.

Then, a skew correction operating process is executed as the bill remains in this state (ST10). The skew correction operating process is conducted by driving the motor 40 for the skew correction mechanism to rotate normally to drive the pair of movable pieces 10A to get closer with each other. That is, in this skew correction operating process, as shown in the flowchart of FIG. 13 the motor 40 described above is driven to rotate normally to move the pair of movable pieces 10A in respective directions such that the pair of movable pieces 10A get closer with each other (ST110). The movement of the movable pieces is continued until the distance therebetween becomes the minimum width (for example; width of 62 mm) of the bill registered in the reference data storage part in the control means.

When the skew correction operating process as described above is completed, a traveling route opening process is subsequently executed (ST11). This process is conducted by moving the pair of movable pieces 10A in separating directions as the above-described motor 40 for the skew correction mechanism is driven to rotate reversely (refer to ST100 to ST102 of FIG. 12).

Next, the above-described roller up-and-down motor 70 is driven to move the upper conveyor roller 14A to contact the lower conveyor roller 14B, and the bill is nipped and held between the pair of conveyor rollers (14A and 14B) (ST12). Thereafter, the bill conveyor motor 13 is driven to rotate normally to convey the bill into the inside of the apparatus, and when the bill passes through the bill reading means 8, a reading process of the bill is executed (ST13 and ST14).

Figure 14:
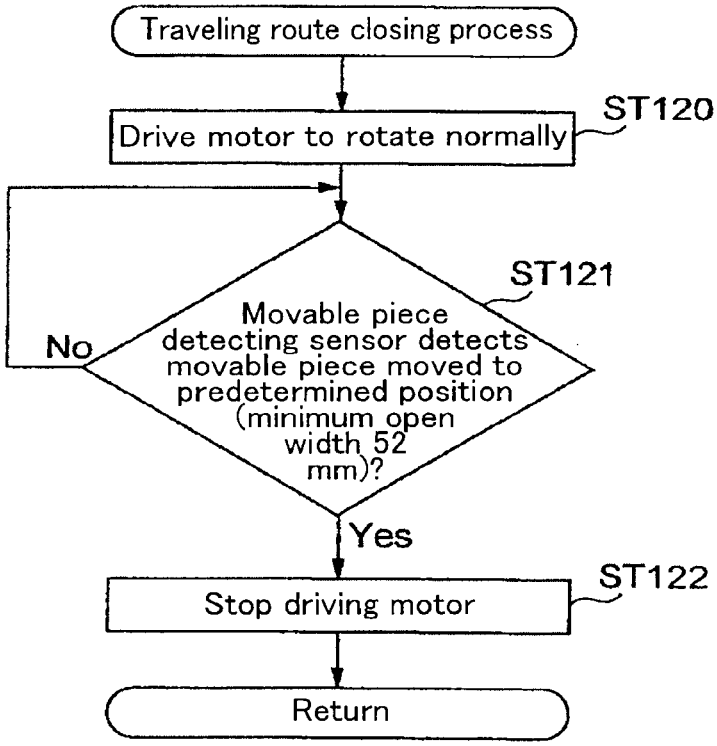
FIG. 14 shows a flowchart illustrating processing operations of a traveling route closing process.

Then, when the bill to be conveyed passes through the bill reading means 8, and the trailing end of the bill is detected by the movable piece detecting sensor 12 (ST15), a process for closing the bill traveling route 3 is executed (ST16). In this process, first, as shown in the flowchart of FIG. 14, after the trailing end of the bill is detected by the movable piece detecting sensor 12, the above-described motor is driven to normally rotate to move the pair of movable pieces 10A in the directions that they get closer to each other (ST120). Next, when it is detected that the movable pieces 10A move to the predetermined positions (minimum open width positions: for example, width of 52 mm) (ST121) by the movable piece detecting sensor that detects the positions of the movable pieces, the driving operation of the normal rotation of the motor 40 is stopped (ST122).

With this traveling route closing process, the pair of movable pieces 10A are moved to the positions of the minimum open width (width of 52 mm) narrower than the width of any bill allowed to be inserted, thereby effectively preventing the bill from being drawn out. That is, by executing such a bill traveling route closing process, an opening distance between the movable pieces 10A is made shorter than the width of the inserted bill, thereby enabling the effective prevention of an action of drawing-out the bill in the direction toward the insertion slot by the operator for illicit purposes.

In succession to the traveling route closing process described above (ST16), a conveyor roller pair spacing process is executed such that the above-mentioned roller up-and-down motor 70 is driven to make the conveyor roller pair (14A, 14B) having been in a state capable of nipping and holding the bill therebetween separate from each other (ST17). By executing the conveyor roller pair spacing process, even if the operator additionally inserts (double insertion) another bill by mistake, the bill is not subject to a feeding operation by the conveyor roller pair (14A, 14B) and hits front ends of the pair of movable pieces 10A in a closed state according to ST16 such that it is possible to reliably prevent the operation of bill double-insertion.

Along with the bill traveling route closing process as mentioned above, when the bill reading means 8 reads the data up to the trailing end of the bill, the bill conveyor motor 13 is driven for a predetermined amount and stops the bill in a predetermined position (an escrow position; a position where the bill is conveyed toward the downstream by 13 mm from the center position of the bill reading means 8), and at this time, an authenticity judgment process of the bill is executed in the control means 200 (ST18 to ST21).

When the bill is judged as the legitimate bill (ST22; Yes) in the authenticity judgment process of ST21 as described above, the control part 180*c* of the pulse output part 180 for driving the motor instructs the pulse generator 180*b* to output a motor driving pulse (corresponding to 1200 pps) such that a conveyance speed of the bill is set to the high conveyance speed (304.8 mm/s), and thereafter, the motor (stepping motor) 13 for conveying the bill is driven to normally rotate (ST23, ST24). Thus, the bill is conveyed at the speed higher than the normal conveyance speed by the bill conveyance mechanism 6. While the bill is conveyed, the bill conveyor motor 13 is driven to rotate normally until the back end of the bill is detected by the discharge detecting sensor 18 (ST25), and after the back end of the bill is detected by the discharge detecting sensor 18, the bill conveyor motor 13 is driven to rotate normally by the predetermined amount (ST26 and ST27).

The process for driving the bill conveyor motor 13 to rotate normally in ST26 and ST27 corresponds to a driving amount for which the bill is conveyed in the receiving port 103 of the bill housing part 100 from the discharge slot 3*a* on the downstream side of the bill traveling route 3 of the apparatus main body 2 so that the pair of belts 150 contact the surface on both sides of the conveyed-in bill to guide the bill stably to the press standby part 108. That is, by further driving the bill conveyor motor 13 to rotate normally for a predetermined amount after the back end of the bill is detected by the discharge detecting sensor 18, the pair of belts 150 contact the bill conveyed-in and are driven in the bill feeding direction so as to guide the bill in a stable state to the press standby part 108.

Then, after the above-described bill conveyor motor 13 is stopped, the process for driving the presser plate 115 is executed (ST28) such that the bill is placed on the placing plate 105. And, after the pressing process is completed, the presser plate 115 is again moved to the standby position and stopped to the position.

Figure 12:
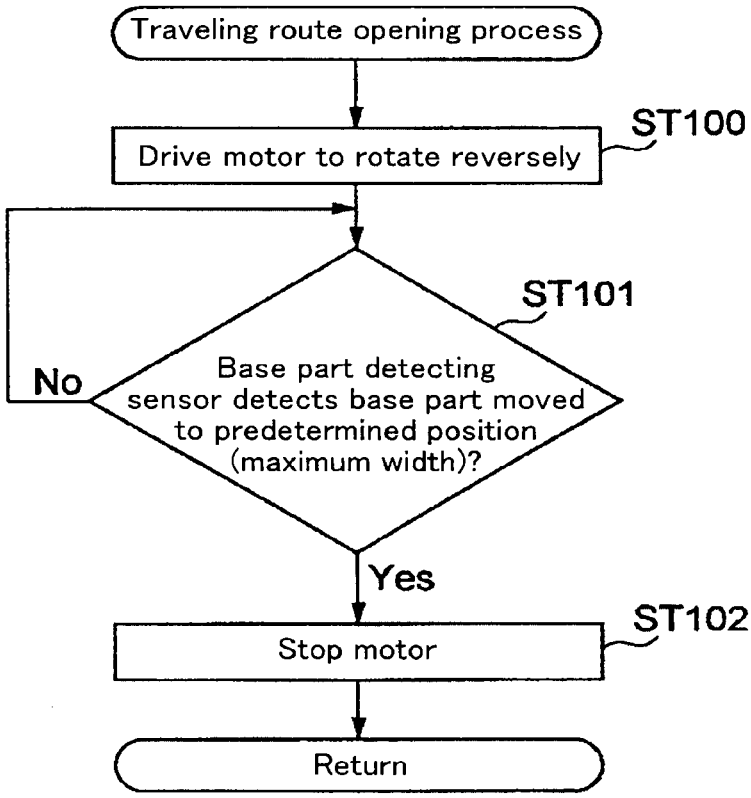
FIG. 12 shows a flowchart illustrating processing operations of a traveling route opening process.

Further, in the above-mentioned process of ST21, when the bill is judged as a non-legitimate bill, a traveling route opening process is executed (ST51, refer to ST100 to ST102 of FIG. 12). After that, the bill conveyor motor 13 is driven to rotate reversely and the conveyor roller pair (14A, 14B) are brought in contact with each other such that the bill waiting at the escrow position is conveyed toward the bill insertion slot 5 (ST52 and ST53).

In this case, the conveyance speed at which the bill is returned toward the bill insertion slot 5 is the normal speed which is set in the step of ST05 as described above. However, because the bill is merely returned, the motor driving pulse output part 180 may control the drive of the bill conveyor motor 13 at the high speed (which may be, for example, the speed set in the step of ST23 as described above, or may be a speed even higher than that).

Further, with the configuration of this embodiment, even when it is judged that the read bill is not the legitimate bill, the bill is not immediately discharged out of the apparatus, but a reading process is repeated for a predetermined number of times (three times) as shown in the following steps.

That is, when the bill is conveyed toward the bill insertion slot 5 in ST53 as described above, and the insertion detecting sensor 7 detects the trailing end of the bill to be returned toward the bill insertion slot 5, the driving to reversely rotate the bill conveyor motor 13 is stopped (ST54, ST55). At this time, it is judged whether or not the bill authenticity judgment process has been carried out for three times (ST56), and when the bill authenticity judgment process has not been carried out three times (ST56, No), the above-mentioned processes in the step of ST06 and subsequent steps thereof are performed. Further, when the bill authenticity judgment process has been carried out for three times (ST56, Yes), the bill authenticity judgment process is no longer carried out, and a discharge process thereof is performed.

This discharge process is performed such that the above-described roller up-and-down motor 70 is driven to allow the conveyor roller pair (14A and 143) holding the bill therebetween to be spaced apart from each other (ST57), and thereafter, the traveling route closing process is executed (ST58, refer to ST120 to ST122 in FIG. 14), and the motor 20 for driving the presser plate 115 is driven to normally rotate by a predetermined amount (ST59), to drive the presser plate 115 staying in the initial position to move to the standby position.

According to the bill processing apparatus in which the procedure of the processes as described above is performed, since the conveyance speed of the bill by the bill conveyance mechanism 6 is controlled to be increased after completion of reading the bill by the bill reading means 8, it is difficult to draw the bill out after completion of the reading process, which makes it possible to reduce opportunities to draw out the bill by fraudulent activities. Further, since the conveyance speed of the bill is not increased before completion of the reading process such that the reading accuracy is not lowered and since the high speed process is achieved after completion of the reading process, the speed of processing the bill as a whole is improved. Moreover, in this embodiment, since the apparatus is so configured that the conveyance speed of the bill is increased after completion of the reading process to feed the bill to the bill housing part 100, it is possible to reliably feed the bill to the press standby part 108 of the bill housing part 100 by its inertia. That is, it is possible to more reliably guide the bill to a predetermined pressing position by the conveyor member (belt 150).

Further, in this embodiment, since the conveyance speed of the bill conveyance mechanism 6 is controlled to be increased after the bill is judged as the legitimate bill as a judgment result of the authenticity judgment in the control means 200 after the reading process is completed, it is possible to effectively prevent a fraudulent activity such as drawing out the bill having been judged as the legitimate bill. Moreover, since the bill conveyor motor 13 of the bill conveyance mechanism 6 is constituted of the stepping motor, it is possible to simplify the driving circuit for controlling the speed, thereby enabling to reduce the cost.

Figure 11:
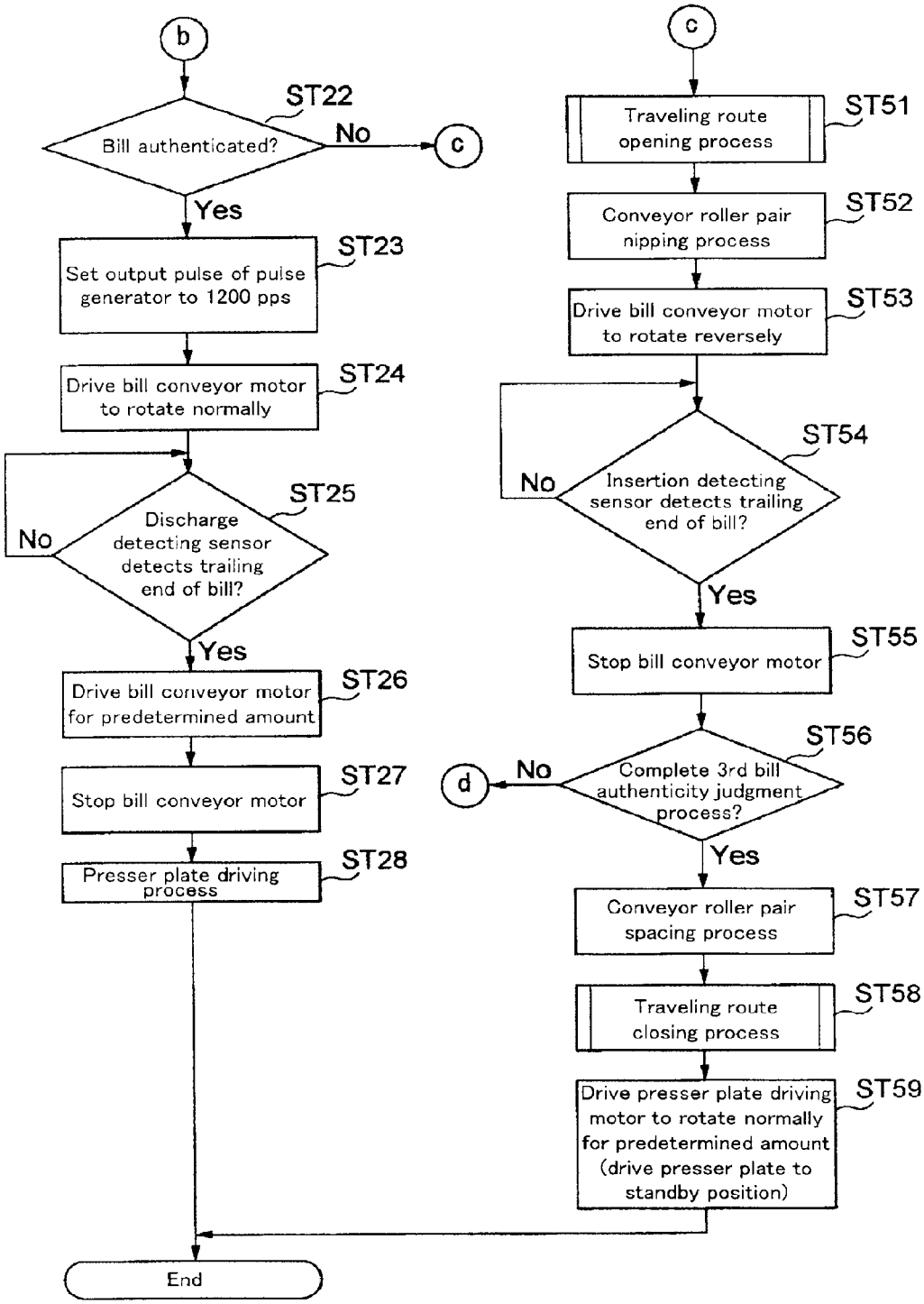
FIG. 11 shows a flowchart (part three) illustrating processing operations for processing the bill in the bill processing apparatus of this embodiment.
Figure 15:
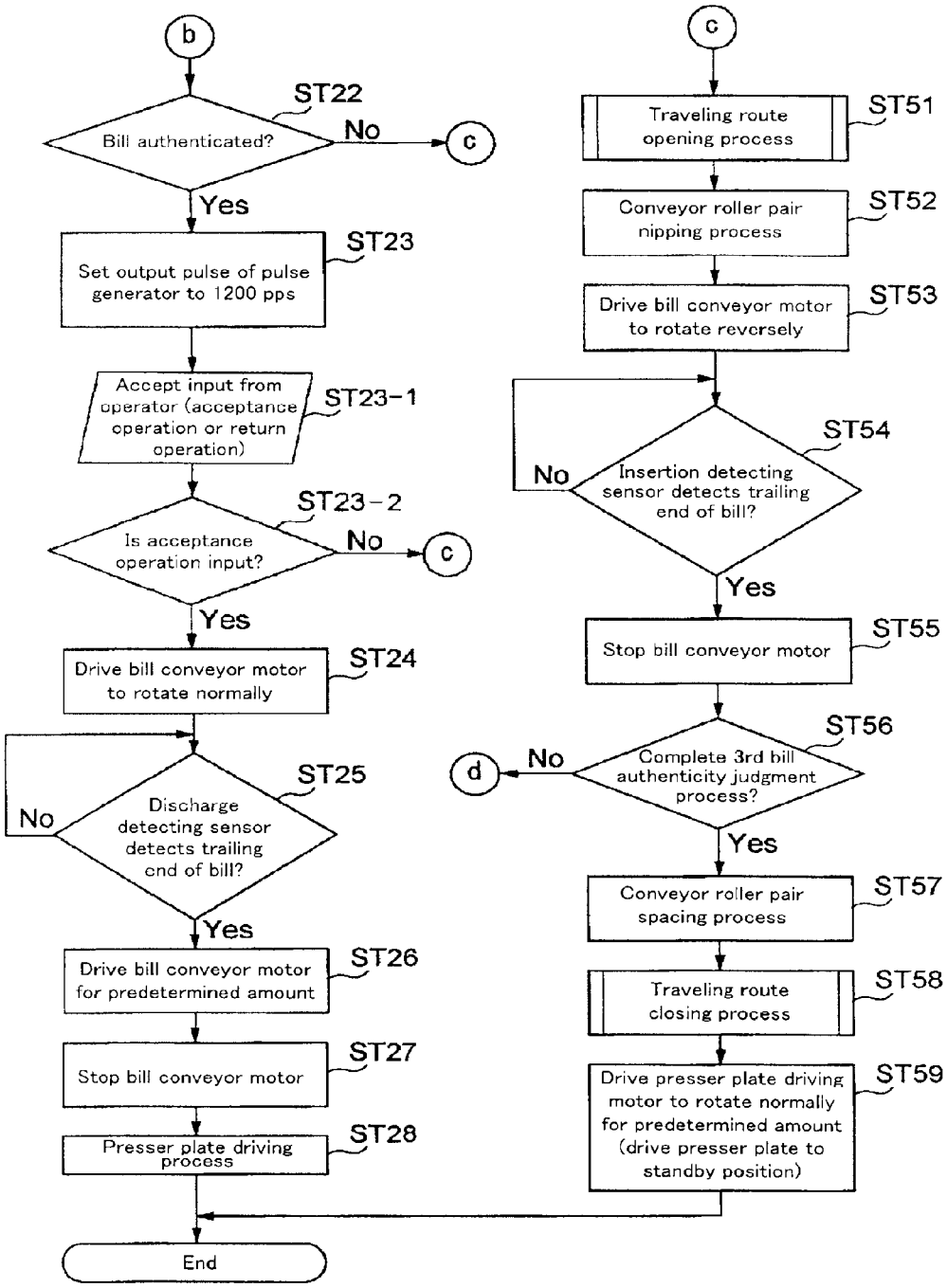
FIG. 15 shows a flowchart illustrating processing operations for processing the bill with a bill processing apparatus of another embodiment corresponding to the flowchart of FIG. 11.

FIG. 15 shows a flow chart of another embodiment different from the embodiment of the flow chart as shown in FIG. 11. In the flow chart, when the bill is judged as the legitimate bill (ST22; Yes), the control part 180*c* of the pulse output part 180 for driving the motor instructs the pulse generator 180*b* to output the motor driving pulse (corresponding to 1200 pps) (ST23) such that the conveyance speed of the bill is set to the high conveyance speed, and thereafter, an input from the operator is received (ST23-1). This input corresponds to an acceptance operation in which the operator presses an acceptance button in order to accept provision of services (for example, in the case of a gaming device, an acceptance process accompanied by start of a game), and a return operation in which the operator presses a return button in order to execute a process for returning the inserted bill. Then, when an operation to accept the provision of various types of services is input (ST23-2; Yes), the bill conveyor motor 13 is consecutively driven to rotate normally to convey the bill in this state toward the bill housing part 100 (ST24). Since the other flows than this series of flows are the same as shown in FIG. 11, explanations thereof are omitted.

In this way, the bill is fed into the press standby part 108 of the bill housing part 100, from which it is difficult to draw the bill out, at a higher speed after the input from the operator is received (for example, an initial setting for providing services is carried out), which reduces the opportunities of drawing out the bill by a fraudulent activity (for example, a period of time in which a drawing activity can be committed). Further, the input from the operator is received (ST23-1) after instructing the pulse generator 180*b* to output the motor driving pulse (corresponding to 1200 pps) (ST23), a discharge process is performed at a higher speed as compared with a case where a discharge process is performed without judging that the bill is the legitimate bill.

Figure 16:
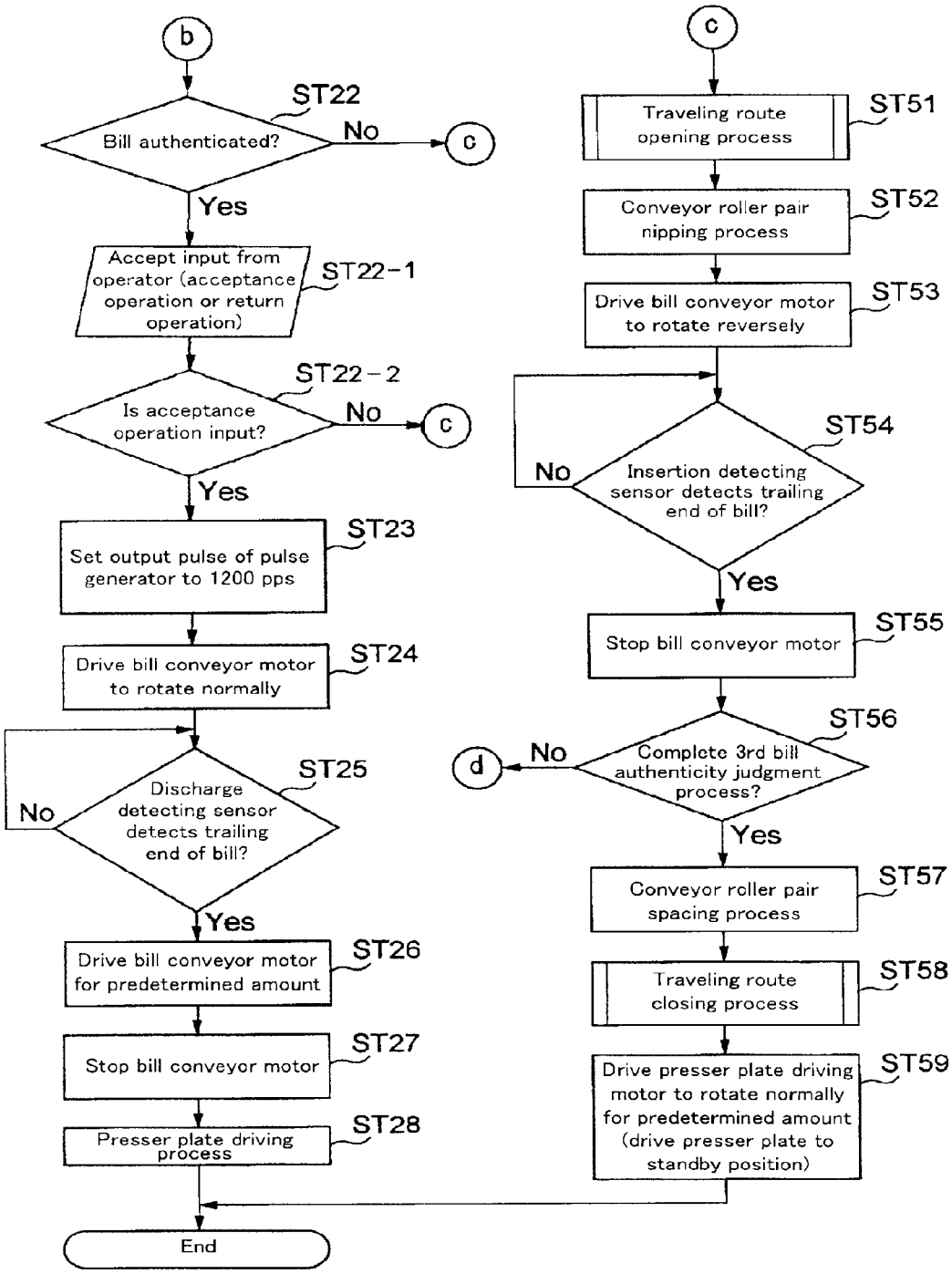
FIG. 16 shows a flowchart illustrating processing operations for processing the bill with a bill processing apparatus of yet another embodiment corresponding to the flowchart of FIG. 11.

FIG. 16 shows a flowchart of yet another embodiment, which is different from that of FIG. 15, and after an input from the operator is received (ST23-1), the control part 180*c* of the pulse output part 180 for driving the motor instructs the pulse generator 180*b* to output the motor driving pulse (corresponding to 1200 pps) (ST23) such that the conveyance speed of the bill is set to the high conveyance speed. According to this embodiment, the conveyance speed is increased only when the bill is judged as the legitimate bill and the operator is going to receive some sort of service (here, request of returning the bill is excluded), it is possible to keep the probability of break down such as paper jamming caused by the high speed feeding.

As mentioned above, embodiments of the present invention are described. However, the present invention is not limited to the above-described embodiments, and various modifications of the present invention can be implemented. The present invention may be preferably so configured that the bill is inserted into the bill insertion slot 5, to be conveyed to the bill reading means 8 at a normal conveyance speed, and after completion of the reading process therein, the conveyance speed of the bill may be controlled to be increased, and the specific conveyance speed is not particularly limited to, and a configuration thereof may be appropriately modified. Further, in this embodiment, the bill is once stopped at the escrow position. However, this embodiment may be applied to the configuration in which the bill is not stopped, but continuously conveyed to be processed.

Further, the motor 13 of the bill conveyance mechanism that conveys the bill may be constituted of, not only a stepping motor, but also a DC motor, for example. Further, the components of the bill conveyance mechanism 6, the bill reading means 8, and the like are not limited to those in the above-described embodiments, and may be variously modified.

In this way, there may be provided a paper sheet processing apparatus comprising: an insertion slot into which a paper sheet is inserted, a conveyance mechanism which is capable of conveying the paper sheet inserted from the insertion slot, reading means which reads the paper sheet being conveyed by the conveyance mechanism, authenticity judging means which judges the authenticity of the paper sheet having been read by the reading device, and control means which controls a conveyance speed of the paper sheet by the conveyance mechanism, and wherein the control means controls the conveyance speed of the conveyance mechanism after reading by the reading means is completed.

According to the paper sheet processing apparatus of the above-described embodiment, since the apparatus is so configured that the conveyance speed by the conveyance mechanism is controlled after completion of reading by the reading means including the reading apparatus, it is possible to increase the conveyance speed of the paper sheet when reading a paper sheet or the like is completed, for example, thereby making it difficult to draw out the paper sheet or the like after completion of the reading process, and it is possible to reduce opportunities of drawing out the paper sheet or the like by fraudulent activities.

Further, the control means controls the conveyance speed by the conveyance mechanism on the basis of a judgment result by the authenticity judgment means.

In the above-described embodiment, since it is possible to increase the conveyance speed of the paper sheet, for example, after the paper sheet is judged as being legitimate by the authenticity judgment means, it is possible to effectively prevent the fraudulent activity such as drawing out the legitimate paper sheet or the like.

Further, the conveyance mechanism includes the stepping motor driven by the pulse signal, and the control means controls the conveyance speed by changing a generation cycle (period) of the pulse signal.

In the above-mentioned embodiments, it is possible to control the conveyance speed only by changing the cycle (period) of generating the pulse signals with the control means.

As described above, there is provided a paper sheet processing apparatus which can prevent the action of drawing out the bill by the fraudulent activity after completion of the reading process.

The present invention can be applied not only to the bill processing apparatus, but also to a device which provides products and services when the paper sheet such as a service ticket and a coupon ticket, for example, is inserted.

What is claimed is:

1. A processing apparatus of a paper sheet, comprising:

an insertion slot through which the paper sheet is inserted;

a conveying device comprising a stepping motor driven with a pulse signal and configured to convey the paper sheet inserted through the insertion slot;

a reading device configured to read an information from the paper sheet conveyed by the conveying device;

a judging device configured to judge an authenticity of the paper sheet based on the information read by the judging device;

a controller configured to control a conveyance speed of the conveying device;

a housing device configured to stack and house the paper sheet;

a discharge detecting sensor configure to detect a discharge of the paper sheet to the housing device; and a conveying member configured to contact and guide the paper sheet inserted through a receiving port of the housing device, wherein the controller, after the information from the paper sheet is read by the reading device, increases the conveyance speed of the conveying device by changing pulse period of the pulse signal provided to the stepping motor based on judge result of the judging device and, after a back end of the paper sheet passing through is detected by the discharge detecting sensor, controls the stepping motor to rotate for a predetermined amount to convey the paper sheet until the paper sheet contacts the conveying member.

2. The processing apparatus of a paper sheet of claim 1, further comprising a skew correcting mechanism configured to accurately position the paper sheet inserted through the insertion slot with respect to the reading device.

3. The processing apparatus of a paper sheet of claim 2, wherein the skew correcting mechanism comprises a pair of movable pieces to correct an inclination of the paper sheet by touching both sides of the paper sheet.

4. The processing apparatus of a paper sheet of claim 1, wherein the discharge detecting sensor is disposed right in front of the receiving port of the housing device.

5. The processing apparatus of a paper sheet of claim 1, wherein the housing device comprises:

a placing plate on which the paper sheet is stacked;

a press standby part configured to keep the paper sheet inserted through the receiving port; and a presser plate configured to reciprocate between a first position where the paper sheet is press against the placing plate and a second position where the press standby part is opened.

6. The processing apparatus of a paper sheet of claim 1, further comprising a shutter member configured to prevent the paper sheet from being conveyed back to the insertion slot.

* * * * *